US005726616A

United States Patent [19]

Bell

[11] Patent Number: 5,726,616

[45] Date of Patent: Mar. 10, 1998

[54] TRANSFORMER WITH PLURAL BOBBINS

[75] Inventor: Glen A. Bell, Waterloo, Canada

[73] Assignee: Electronic Craftsmen Limited, Waterloo, Canada

[21] Appl. No.: 646,579

[22] Filed: May 8, 1996

Related U.S. Application Data

[63] Continuation-in-part of Ser. No. 388,871, Feb. 15, 1995, abandoned.

[51] Int. Cl.[6] ..... H01F 27/02; H01F 27/30

[52] U.S. Cl. ..... 336/92; 336/96; 336/192; 336/198; 336/210

[58] Field of Search ..... 336/198, 208, 336/192, 210, 90, 92, 96

[56] References Cited

U.S. PATENT DOCUMENTS

| | | | |
|---|---|---|---|
| 3,359,395 | 12/1967 | Bruce | 336/198 |
| 4,347,490 | 8/1982 | Peterson | 336/198 |
| 4,716,394 | 12/1987 | Gordon | 336/192 |
| 4,851,803 | 7/1989 | Hahn | 336/210 |
| 4,857,878 | 8/1989 | Eng, Jr. et al. | 336/210 |
| 4,939,494 | 7/1990 | Masuda et al. | 336/198 |
| 5,015,984 | 5/1991 | Vialaneix | 336/198 |
| 5,034,854 | 7/1991 | Matsumura et al. | 336/192 |
| 5,157,368 | 10/1992 | Okano et al. | 336/198 |

FOREIGN PATENT DOCUMENTS

| | | | |
|---|---|---|---|
| 0 097 599 | 1/1984 | European Pat. Off. . | |
| 0 485 341 | 5/1992 | European Pat. Off. . | |
| 2311612 | 9/1973 | Germany | 336/208 |
| 144 981 | 11/1980 | Germany | 336/210 |
| 32 47 113 | 8/1983 | Germany | 336/198 |
| 52-76634 | 6/1977 | Japan | 336/198 |
| 60-137007 | 11/1985 | Japan . | |
| 51-51902 | 3/1986 | Japan | 336/198 |
| 61-54608 | 3/1986 | Japan | 336/198 |
| 61-168617 | 7/1986 | Japan | 336/198 |

OTHER PUBLICATIONS

Norwe Electronic Components—"EFD 209–SMD Surface Mount Assembly".

Cosmo—"International Design Transformer Bobbins" pp. 19&20 from Miles Platts Inc/Ltd.

Imperial Range—"Standard Coil Formers for Inperial Lamination".

Ny–Glass Plastics, a Division of Calnetics Corporation—"EI–21 Bobbin".

IBM Technical Disclosure Bulletin, "Bobbin Set For a Low Profile, Safety Approved Transformer", Apr. 1988, vol. 30, No. 11, pp. 58,59.

*Primary Examiner*—Thomas J. Kozma

*Attorney, Agent, or Firm*—Bereskin & Parr

[57] ABSTRACT

A transformer assembly, particularly for data and audio signals, has first and second bobbins which are telescoped within one another. An assembly cap is fitted around the bobbins and includes flanges for locating a core. The bobbins and the cap are designed such that creepage and clearance requirements are met. The core is preformed or comprises laminations formed as E's and I's, which are then fitted through the assembly cap and the bobbins. The cap provides a receptacle for the core, and retains the laminations in position. To secure the laminations in position, an assembly cup is mounted around the outside of the laminations. The assembly cup can include springs or the like, to maintain the laminations in position and allow for expansion and contraction. The springs can additionally mechanically secure the transformer in position. The bobbins, cap, core and cup can be encapsulated together.

27 Claims, 8 Drawing Sheets

TRANSFORMER WITH PLURAL BOBBINS

CROSS-REFERENCE TO RELATED APPLICATION

This application is a Continuation-in-Part of earlier application Ser. No. 08/388,871 filed Feb. 15, 1995, now abandoned.

FIELD OF THE INVENTION

This invention relates to transformers and to a method of assembling transformers, and more particularly is concerned with the construction and assembly of transformers for data and audio transmission applications.

BACKGROUND OF THE INVENTION

There are currently known a wide variety of designs for transformers for signal, e.g. data and audio and similar applications. The design of a transformer is governed both by characteristics required of the transformer itself, as well as the production and assembly requirements necessary for each design.

For example, one known design available from COSMO and the subject of U.S. Pat. No. 4,716,394 has two separate bobbins for the two transformer coils, intended to provide high isolation between primary and secondary windings in power transformers. These two bobbins sub-assemblies are then mounted together in a U-shaped housing.

Another known design has a one piece two-section or three flanged bobbin. A central or intermediate flange separates the two sections of the bobbin. Such an arrangement can suffer from distortion during winding, can suffer from poor coupling between the windings and can provide inadequate creepage distances, to isolate the two coils.

Due to these problems and new standards in Europe and elsewhere concerning creepage and clearance distances at specified working voltages, the two bobbin configuration is often preferred.

However, many existing two bobbin designs suffer from a number of drawbacks or disadvantages. They lack performance requirements for transformers, as well as being ill suited to emerging manufacturing techniques, for manufacturing the transformer itself and for installing a transformer in or on a circuit board. This type of installation is becoming common.

For example, with the advent of Surface Mount Technology (SMT) and hybrid SMT through hole technology, reflow soldering has expanded rapidly. Several distinct challenges lie in applying this technology to a relatively large signal transformer. Different rates for thermal expansion of elements of the transformer (eg. laminations to thermoset plastics), high temperatures which may affect unprotected elements of the transformer (magnetic wire) and the relatively large mass of the transformer for mechanical stability to the circuit board, can all provide challenges for current manufacturing techniques. This is not provided for in many current designs.

For example, a resurgent technique for soldering, known as infrared reflow, is becoming common. In this soldering technique, energy is provided by infrared radiation. Various infrared sources are used. One system that is becoming common uses area or panel emitters providing medium to long wave infrared radiation. Heat is transferred by a combination of radiation, convection and conduction. It also heats the surrounding air by absorption, which supports heating of the parts and the printed circuit board (PCB). The band is also adjusted to the absorption coefficient of the PCB material, which heats the contact pads on the PCB and solder paste. The heating profile to which any individual part is subjected is determined by the component with the highest heat capacity. As a result, some parts may see excessive heat or excessive heating ramps, and mass differences alone can account for 50° C. differences in temperature during a preheat ramp. While gradual heat ramps can be used to minimize this effect, it is nonetheless possible that some components may be subjected to excessive heating. Further, some equipment does not heat evenly across the width of a chamber in which the soldering process takes place. This can be caused by reflection or uneven transmission of radiation, or by the energy absorption of transfer conveyors. Consequently, a disadvantage of this technique is that it heats up the components significantly, and indeed can cause individual components to be subjected to excessive temperature profiles. For this reason, where this soldering technique is used, the individual components must be capable of accepting the necessary temperature profiles and must be capable of the necessary thermal expansion and contraction. This is not provided for in many current designs. Also, the design should be such as to shield relevant components from the infrared heat to the extent necessary.

The use of automated assembly techniques, such as pick and place at the circuit board level require that individual components be provided with elements that will accurately locate these components for through hole insertion or with respect to a pad placement on the circuit board. This is generally not provided for in placement transformer assemblies where the core of the transformer assembly has to be the conventional locating technique.

While known designs of transformers including side by side coils are suitable for power applications, they are unsuited to audio and other applications. For low frequency power applications (less than 100 Hz), one can accept a relatively low degree of efficiency. For high frequency applications, such as audio, data and other information signals, a greater degree of efficiency and coupling is required to maintain signal levels and signal to noise ratios and the like. Leakage inductance for high frequency response should also be minimized. This is accomplished in a concentric design.

For such high frequency applications, in particular signal transformers, it has been proposed to use two coils mounted on a common bobbin. In the past, these devices have been manufactured by placing the first winding on the bobbin and then placing an insulation barrier over the first winding which generally consists of an electrical grade insulating material such as tape. This tape is generally placed in the coil form such that the edges of the tape roll up the sides of the bobbin flange forming a pocket. The second winding is then wound in this pocket. Since the tape is generally very flexible and pliable there is no guarantee that the tape has not folded over on itself or has adequately covered the first winding and hence the insulation integrity may be suspect. For this reason, this configuration is not acceptable for safety requirements to the newer European regulations, which will likely be adopted in North America. There is therefore a need for a transformer design which will provide the coupling requirements for audio, data or other higher frequency signal applications, which will meet current safety regulations and which will be consistent and repeatable in the manufacturing process.

A further problem is encountered in the assembly of signal transformers having to operated with a DC bias being applied to the device. Conventional laminated devices would saturate and therefore cannot be used.

The technique commonly used is to place either an EE or EI ("E" and "I" indicating the shape of the laminations in known manner) configured laminate core in the device using an electrical insulating barrier of a specified thickness (gap) between either the EEs or EIs. This would then be held in place usually by tape around the outside of the laminations. The thickness of the gap may be varied depending on the winding characteristics and the electrical properties of the lamination. This assembly may optionally be held together by wrapping tape around the assembly which may also be a determining factor both in performance and further processing of the transformer. Conventional techniques lend themselves to additional reworking, poor handling and placement of the lamination especially the EIs and poor handling and placement of the gap material. This coupled with taping the assembly provides a difficult task in many known tranformer assembly techniques, requiring significant manual dexterity.

SUMMARY OF THE PRESENT INVENTION

Accordingly, it is desirable to provide a transformer construction, which will be readily susceptible to assembly using modern, emerging assembly techniques, but which at the same time provides the necessary electrical and magnetic characteristics and meets new safety standards for transformers. It should further be suitable for making high efficiency transformers for audio, data and other high frequency applications.

In accordance with one aspect of the present invention, there is provided a transformer assembly comprising:

a first bobbin having a first main bobbin body comprising a first main bobbin portion and first and second end flanges at either end of therefore, and coil wound on the first main bobbin portion, the first main bobbin body defining a first bore for laminations;

a second bobbin having a second main bobbin body comprising a second main bobbin portion and first and second end flanges at either end thereof and having generally similar external dimensions, and a coil wound on the second main bobbin portion, the second main bobbin body defining a second bore, the second bobbin being larger than the first bobbin, the second end flange of the first bobbin being dimensioned to fit within the second bore, and the bobbins being telescoped within one another with the second bore being dimensioned to receive the first main bobbin body; and an assembly cap comprising side and end walls defining a central portion and a substantially rectangular aperture extending through the central portion, in which the first and second bobbins are mounted, with at least one end flange abutting each of the end walls and the end walls including openings aligned with the first bore of the first bobbin for receiving laminations, wherein the assembly cap includes top and bottom flanges provided above and below the openings in the central portion for locating laminations and for providing desired creepage characteristics, and wherein the end walls and the end flanges are all substantially perpendicular to axes of the first and second bores, to permit sliding engagement of the end flanges by the assembly cap and the end flanges abutting the end walls forming a seal sufficient to prevent passage of a liquid resin.

Preferably, the bobbin assembly includes a cap, the cap comprising a central portion enclosing the first and second bobbins and including openings aligned with the bores of the first and second bobbins for receiving laminations or other core elements. Advantageously, the cap includes top and bottom flanges, provided above and below the openings in the central portion for locating laminations, which may be bevelled to facilitate insertion of laminations. For many applications, the top flange will be necessary to provide sufficient creepage and clearance distances from the exposed portions of the outer winding to the core.

Preferably, the bobbin assembly includes a ferromagnetic core, to form a transformer assembly. This coil assembly provides a receptacle or form for the core. The core can either be preformed or preferably comprises a plurality of prestamped layers of magnetic material (laminations) which are then mounted between the top and bottom flanges of the cap. Preferably, the laminations comprise first and second groups of laminations defining a gap or pocket between the two groups of the core, in which a non conductive material (gap) may be placed which prevents saturation of the core under certain operation conditions.

More preferably, the transformer assembly comprising of the coil assembly (inner bobbin, outer bobbin and cap) and the core assembly (preformed core or laminations and gap if required) includes an assembly cup enclosing the coil assembly and core assembly and retaining the core assembly in position.

Location means for locating the laminations in the cup can comprise spring means provided on at least one of the side and end walls of the cap, and optionally ribs integral with at least one of the side and end walls of the cap.

In a preferred embodiment, each of the first and second bobbins or coil forms includes first and second end flanges, with the second end flange of the first bobbin being sized to fit within the bore of the second bobbin, with the first end flanges having similar external dimensions.

In accordance with a further aspect of the present invention, there is provided a transformer assembly comprising:

a first bobbin having a first main bobbin body comprising a first main bobbin portion and first and second end flanges at either end of thereof, and a coil wound on the first main bobbin portion, the first main bobbin body defining a first bore for laminations;

a second bobbin having a second main bobbin body comprising a second main bobbin portion and first and second end flanges at either end thereof and having generally similar external dimensions, and a coil wound on the second main bobbin portion, the second main bobbin body defining a second bore, the second bobbin being larger than the first bobbin, the second end flange of the first bobbin being dimensioned to fit within the second bore, and the bobbins being telescoped within one another with the second bore being dimensioned to receive the first main bobbin body;

an assembly cap comprising side and end walls defining a central portion and a substantially rectangular aperture extending through the central portion, in which the first and second bobbins are mounted, at least two end flanges abutting the end walls and the end walls including openings aligned with the first bore of the first bobbin;

a plurality of laminations configured and mounted to extend through the bore of the first bobbin and to surround the assembly cap; and an assembly cup secured to the assembly cap and maintaining the laminations in position, wherein the end walls and the end flanges are all substantially perpendicular to axes of the first and second bores, to permit sliding engagement of the end flanges by the assembly cap.

The laminations can be separated by a gap material or gap sheet means, in known manner. This can be adjusted to give the desired characteristics.

Preferably, the assembly cap is filled with resin to encase the bobbins within the assembly cap. The coils are then encapsulated to hold the assembly together, and provide an environmental seal for the coils. The resin encapsulating material only encases the coils and leaves the laminations free to float, e.g. to expand and contract due to temperature effects. The resin serves to bind the cap and cup together, and can additionally secure connection pins more firmly. Where the transformer includes such connection pins for surface mounting, advantageously springs within the assembly cup include leg extensions for mounting in through holes of a printed circuit board.

BRIEF DESCRIPTION OF THE DRAWING FIGURES

For a better understanding of the present invention and to show more clearly how it may be carried into effect, reference will now be made, by way of example, to the accompanying drawings, which show a preferred embodiment of the present invention and in which:

FIG. 1 is a perspective view of two bobbins (shown separated) of a transformer assembly in accordance with the present invention;

FIG. 1*a* is a perspective of an alternative mounting pin arrangement;

DESCRIPTION OF THE PREFERRED EMBODIMENT

Figure 1:
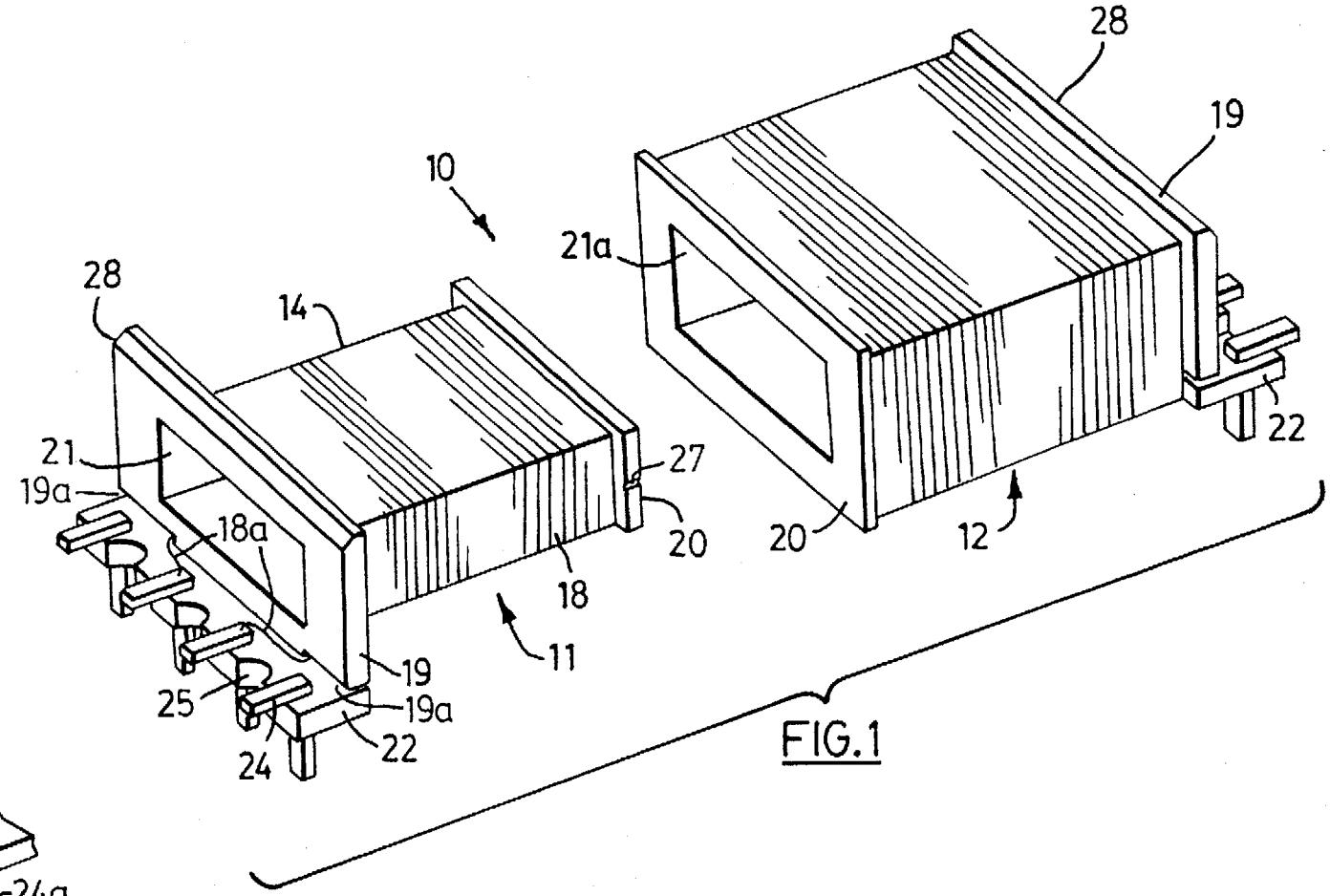

A bobbin assembly according to the present invention is indicated by the reference 10 and comprises a first bobbin 11 and a second bobbin 12. The bobbins or coil forms 11, 12 are similar in many ways, and are described below, in detail, with reference to bobbin 11. The primary difference is that the first bobbin 11 has a main bobbin portion or coil form, that is smaller than the corresponding main bobbin portion of the second bobbin 12, so that the two can be telescoped within one another, as shown.

With reference to the first bobbin 11, it comprises a main bobbin portion 14 having a rectangular, tubular part 16 (FIG. 6), for receiving laminations, as detailed below and on which is wound a coil 18. End flanges 19, 20 define the ends of the main bobbin portion and retain the coil 18 in position. A bore 21 extends through the main bobbin portion 14, and its dimensions are determined by the dimensions of a stack of laminations to be inserted into it.

A mounting flange 22 is perpendicular to the end flange 19 and has an appropriate number of connecting pins 24 mounted in it. Inserts 25 with a half moon profile are provided as insulation between the pins 24 in known manner to enable wires to be cut, the inserts 25 being part of the flange 22.

As shown in the drawings, the end flange 20 is longer in the axial direction then the end flange 19, or corresponding end flanges of the bobbin 12 detailed below. The reason for this is to provide adequate creepage and clearance distances between the coil 18 and laminations, detailed below. E-Shaped laminations are inserted, in known manner, with the central leg of the E-Shape extending through the tubular part 16. As the flange 20 has a small dimension in a direction perpendicular to the axis of the bobbin, it could provide inadequate clearance and creepage characteristics. For this reason, it is provided with a relatively long axial length. For example, where the overall bobbin has a length measured from the outside of the flanges of the order of 14 mm, then the flange 20 can have an axial length of 2 mm, radial extent or height of 1 mm and the wall thickness, where the coil 18 is wound, can be 0.5 mm.

As indicated at 19*a*, the flange 19 is provided with slots immediately above the mounting flange 22. These are deep enough to extend to the coil 18. This enables connecting wire ends 18*a*, to be fitted into these slots 19*a* and soldered to connecting pins 24, in known manner.

Conventionally, the ends of the coil are often brought down under the mounting flange 22 or its equivalent and soldered directly onto the pins. The present arrangement provides various advantages. It provides a greater insulation, and provides better creepage and clearance characteristics. The wire ends 18*a* are brought out on top of the flange 22, to improve these characteristics, and protect the wire ends 18*a*.

Although not shown, the second bobbin 12 correspondingly has slots, equivalent to the slots 19*a*, so that the ends of its coil can similarly be brought out on top of the flange and connected to the respective connecting pins 24. Clearly, because of the greater outside dimension of the coil and the bobbin 12, the slots will be of lesser depth.

The second bobbin 12 is assembled in a similar manner, and has a bore 21*a* dimensioned to enable the main bobbin portion of the first bobbin 11 to be slid into it. The bobbins 11,12 are then slid into one another to form the assembly shown in FIG. 2. An electrical insulating material can optionally be placed around the bobbin 12 for either aesthetics or for additional insulation, especially in the event that the end user of the transformer places traces on a printed circuit board either near or under the transformer. The flanges 19 are bevelled at 28 for reasons detailed below.

Figure 10:
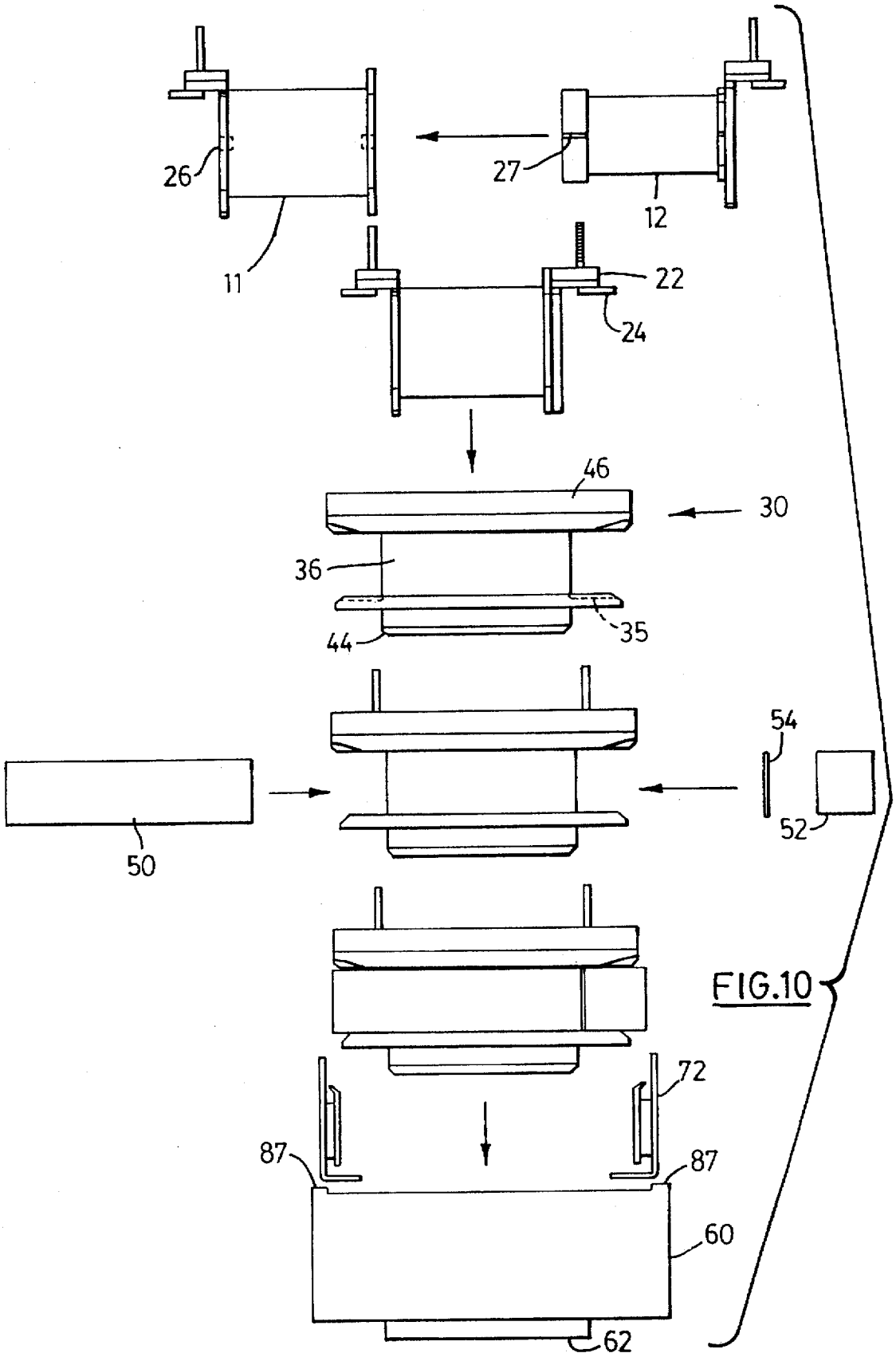
FIG. 10 is a schematic side view of the bobbins, the cap and the cup.

To provide for secure engagement of the bobbins 11, 12, the end of the bore 21*a*, adjacent the flange 19 of the bobbin 12 is provided with a pair of opposite slightly raised projections 26 are provided (FIG. 10). Correspondingly, the elongated end flange 20 is provided with small ribs 27. When the bobbins 11, 12 are assembled, the projections 26 and ribs 27 form an interference fit, to secure the bobbins together.

Figure 2:
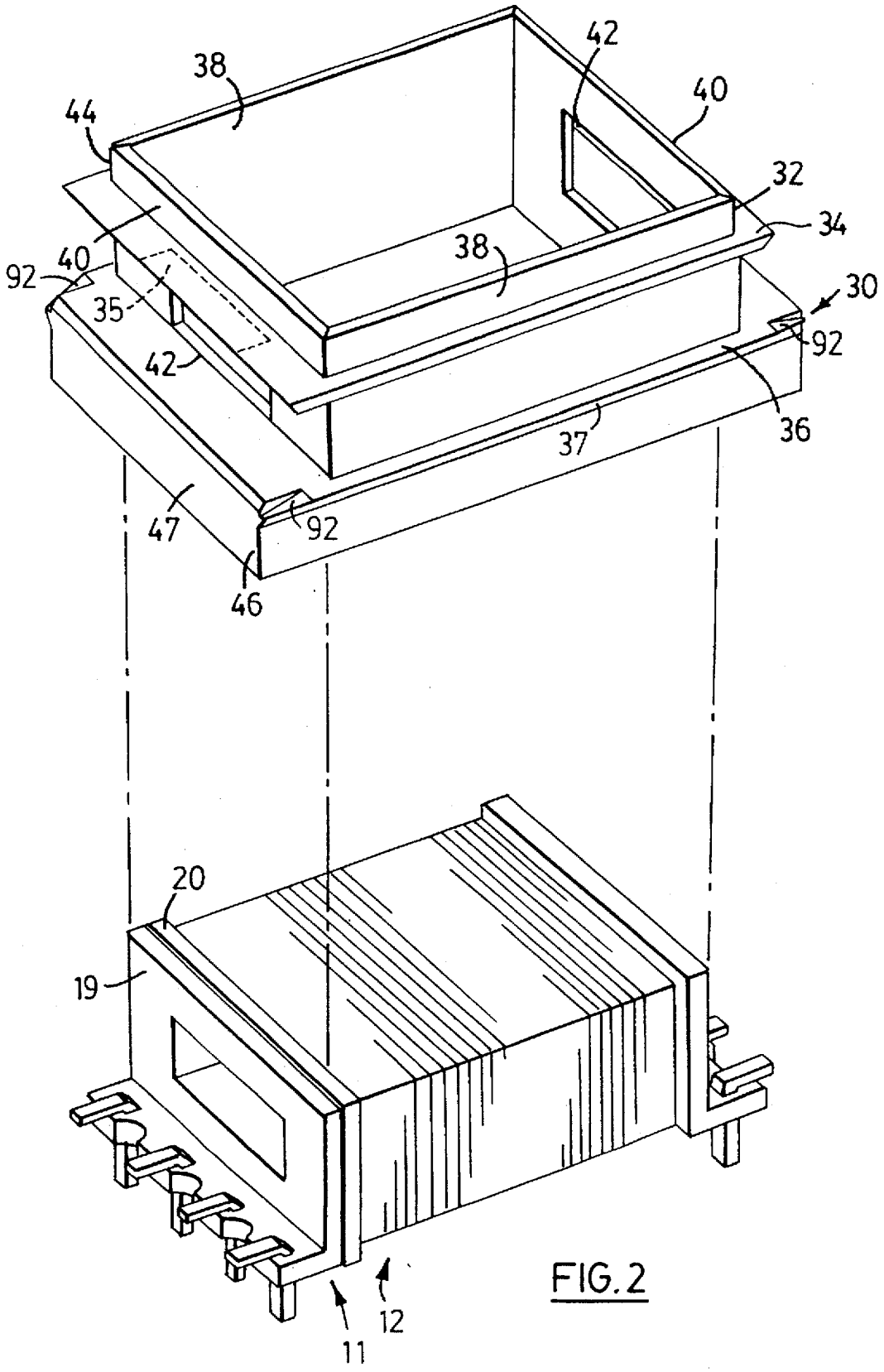
FIG. 2 is a perspective exploded view of the bobbin assembly of FIG. 1 and an assembly cap.
Figure 3:
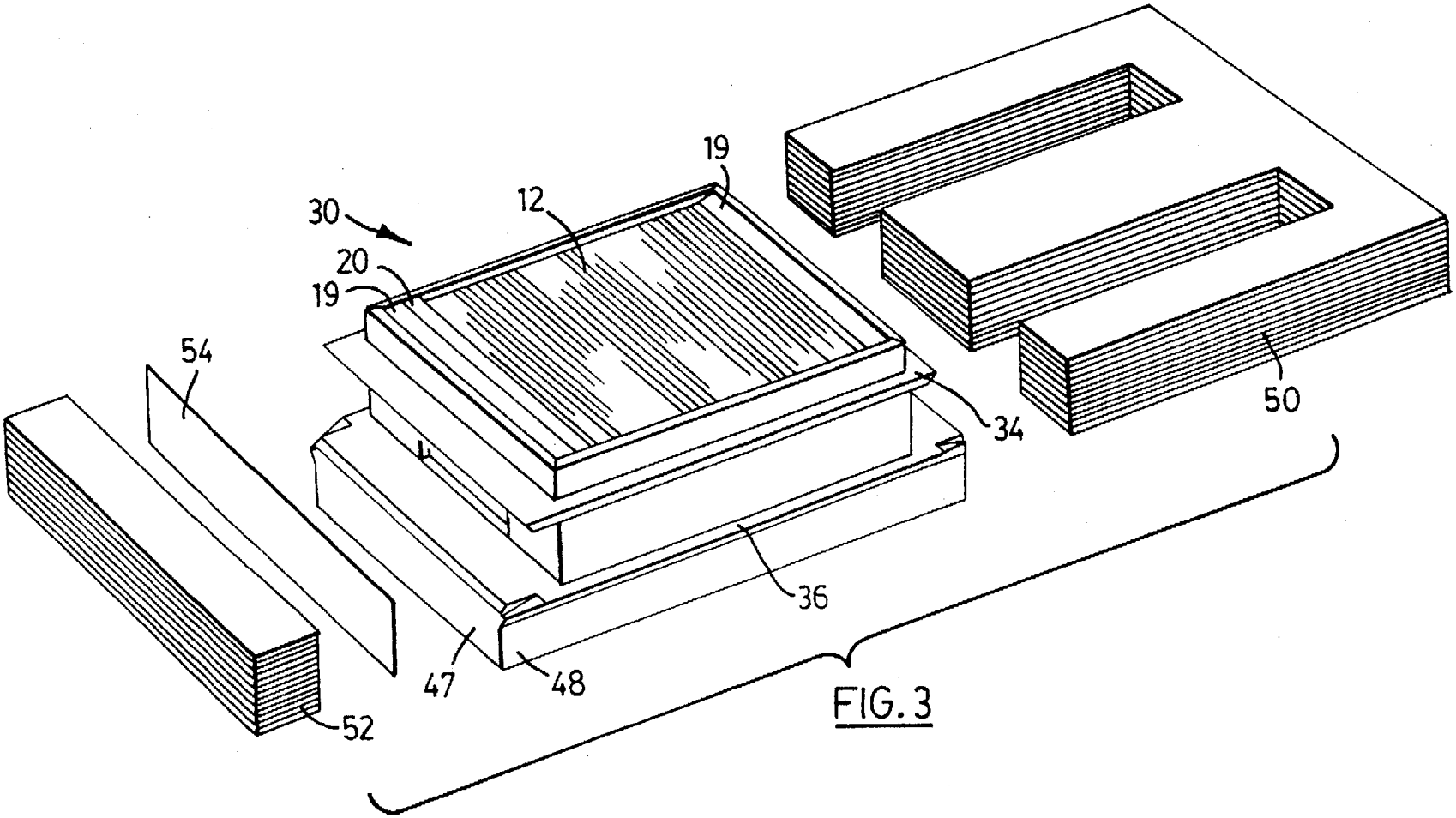
FIG. 3 is a perspective view showing insertion a core and placement of gap,material.

FIGS. 2 and 3 also show an assembly cap 30 for fitting over the first and second bobbins 11, 12. This assembly cap 30 has a central portion 32 which is generally rectangular in section and which is defined by a top flange 34 and a bottom flange 36. The central portion 32 has two side walls 38 and two end walls 40, which define the rectangular central portion or aperture 32. The end walls 40 include openings 42 for laminations, as detailed below. The walls 38, 40 extend above the top flange 34, as indicated at 44.

Edges of the flanges 34, 36, at either end, are bevelled, the bevelled surfaces facing one another as shown at 34*a*, 36*a* (FIG. 6) so as to facilitate insertion of laminations.

Beneath the bottom flange 36, there is a downwardly extending lip 46 defining a shallow recess for receiving the mounting flanges 22. This lip 46 is generally rectangular and includes end parts 47 generally flush with edges of the bottom flange 36, and side parts 48 set in from the edges of the flange 34. This lip 46 is configured to improve the creepage characteristics of the transformer, and for this reason it is set in from the side edges, to maximize the creepage distance with respect to the laminations. It extends to the bottom flange 36, at the ends, so as to accommodate the mounting flanges 22. The flanges 34, 36 are dimensioned to give the desired creepage and clearance characteristics between the laminations and the outer coil.

As shown in FIG. 2, along either edge, the flange 36 has an inclined edge surface 37. Additionally, as shown at 92, corners of the flange 36 have inclined surfaces, to facilitate insertion of the side legs of the E-shaped core pieces.

To further facilitate insertion of the core pieces, the top flange 34 includes set back portions 35, as indicated in dotted outline in FIGS. 2 and 10. These provide increased room for insertion of the central legs of the E-shaped pieces.

Figure 6:
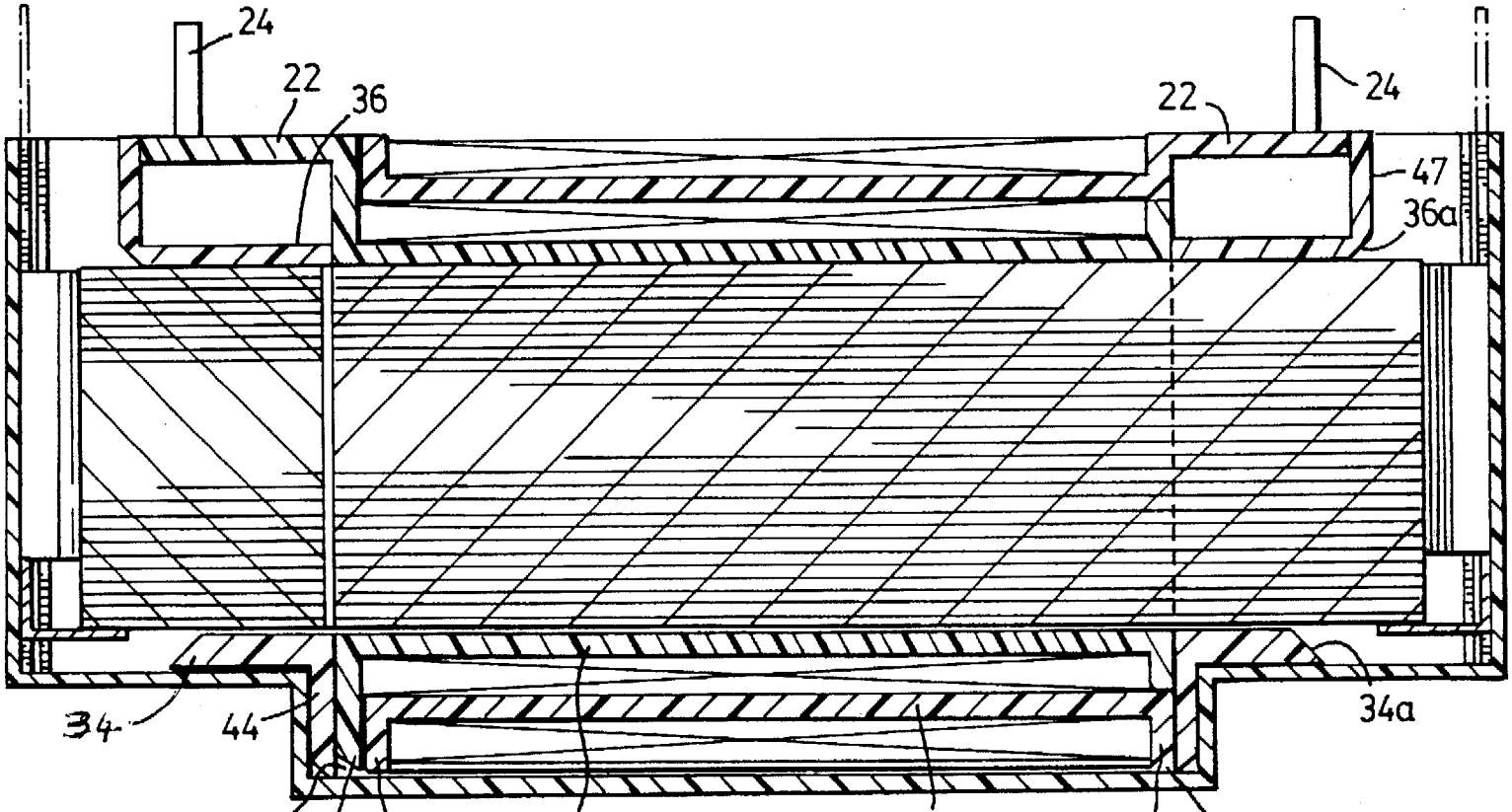
FIG. 6 is a side view, in partial section, of the complete transformer assembly.
Figure 7:
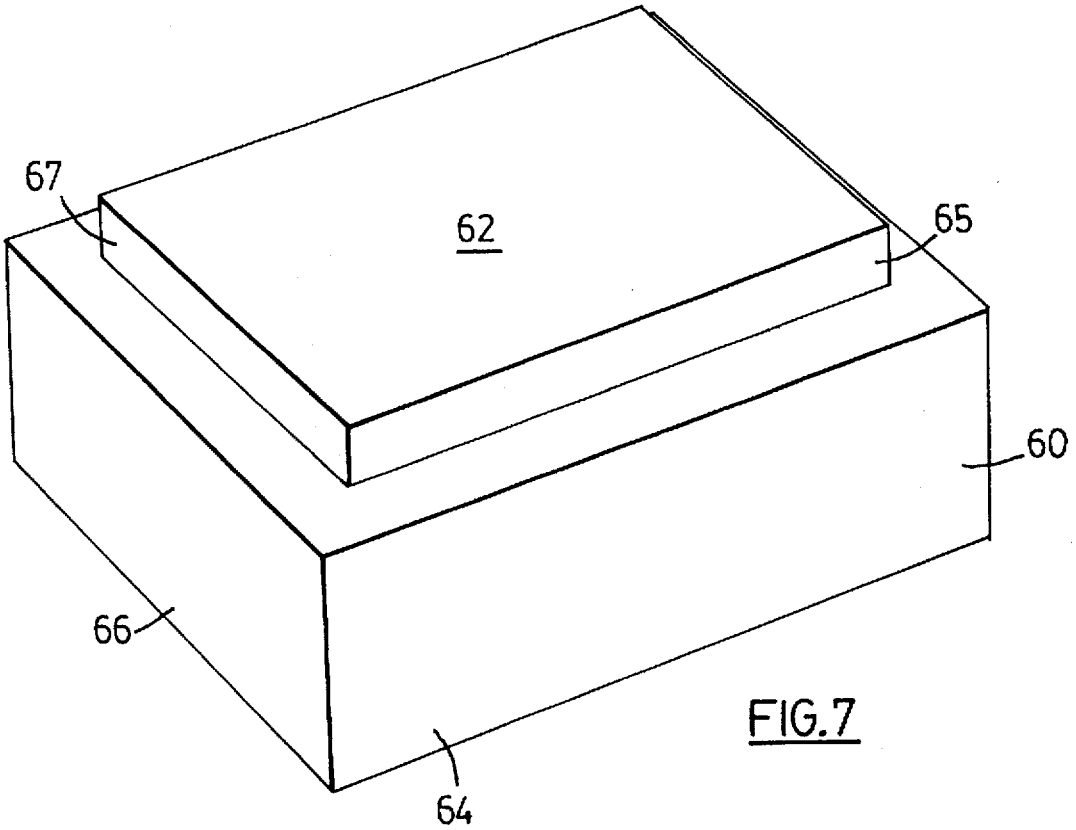
FIG. 7 is a top perspective view of the complete transformer.
Figure 8:
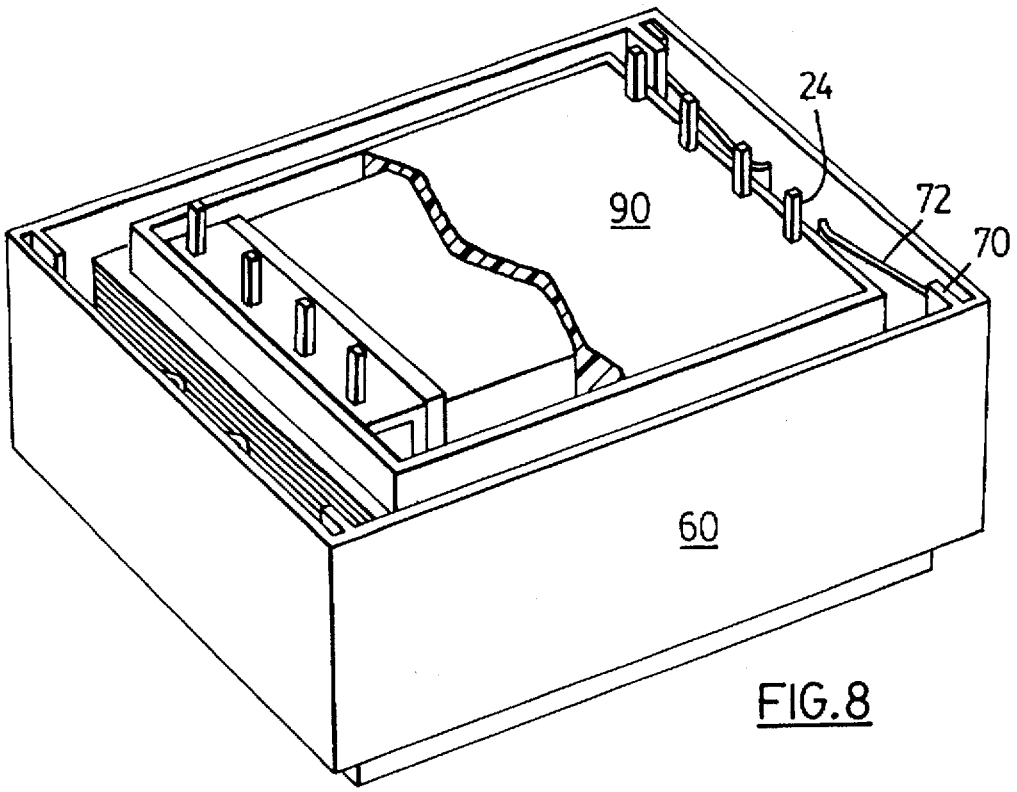
FIG. 8 is a bottom perspective view of the complete transformer.

As shown in FIGS. 3 and 6, the assembly of the first and second bobbins 11, 12 is mounted in rectangular aperture of the central portion 32 of the assembly cap 30, with the end flanges 19, 20 below the top of the cap 30. The bevelled edges 28 facilitate insertion of the bobbins 11, 12 into the cap 30. The bobbins 11, 12 form a snug or interference fit within the assembly cap 30. More particularly, it is the dimensions of the inner bobbin 11 which are critical since this abuts the cap 30 at both ends. The bobbin 11 is axially a few thousandths of an inch longer than the length between the end walls 40, so as to form an interference fit and to form a seal for resin. Only the connecting pins 24 project beyond the edge of the lip 46, as shown in FIG. 6. The bobbins 11, 12 with the cap 30 form a coil assembly.

Now, in known manner, a core is provided. The core can be preformed, or as shown here, can comprise a plurality of laminations, formed from magnetic steel or other ferromagnetic material and provided as a plurality of E-shaped pieces and I-shaped pieces, commonly known as E's and I's, as shown in FIG. 3. It also includes a gap material.

Figure 4:
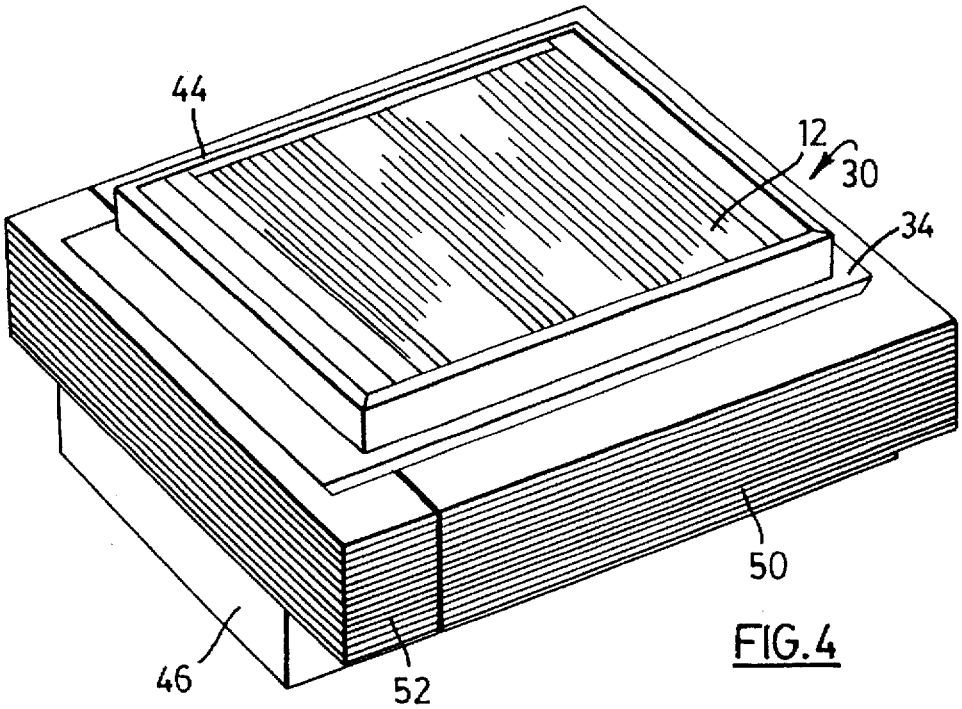
FIG. 4 is a perspective view showing the bobbin assembly, assembly cap and laminations.

The E's 50 are assembled as a stack and inserted with the central leg of the E's extending through the openings 42 and through bores 21 of the first and second bobbins 11, 12. The ends of the legs of the E's 50 are then approximately flush with the outside of the end wall 40 (FIG. 6). An insulating strip of gap material 54 is provided against the ends of the legs of the E's 50. The I's 52 as a stack are then located against the E's 50, separated only by the insulating gap material 54, such as a strip of paper or mylar. The gap material 54 may optionally be wrapped around the top and the bottom of the I's 52. For known reasons, the gap material 54 is desirable, to prevent saturation of the magnetic laminations, so as to obtain the desired magnetic characteristics. It will be appreciated that the bevelling of the flanges 34,36 facilitates insertion of the stacked laminations 50, 52 between them. The laminations 50, 52 can have a clearance of, for example, 0.010 inches with respect to the cap and bobbin assembly, to allow for thermal expansion and contraction. The assembled bobbins 11,12 with the laminations 50, 52 are then as shown in FIG. 4.

Figure 5:
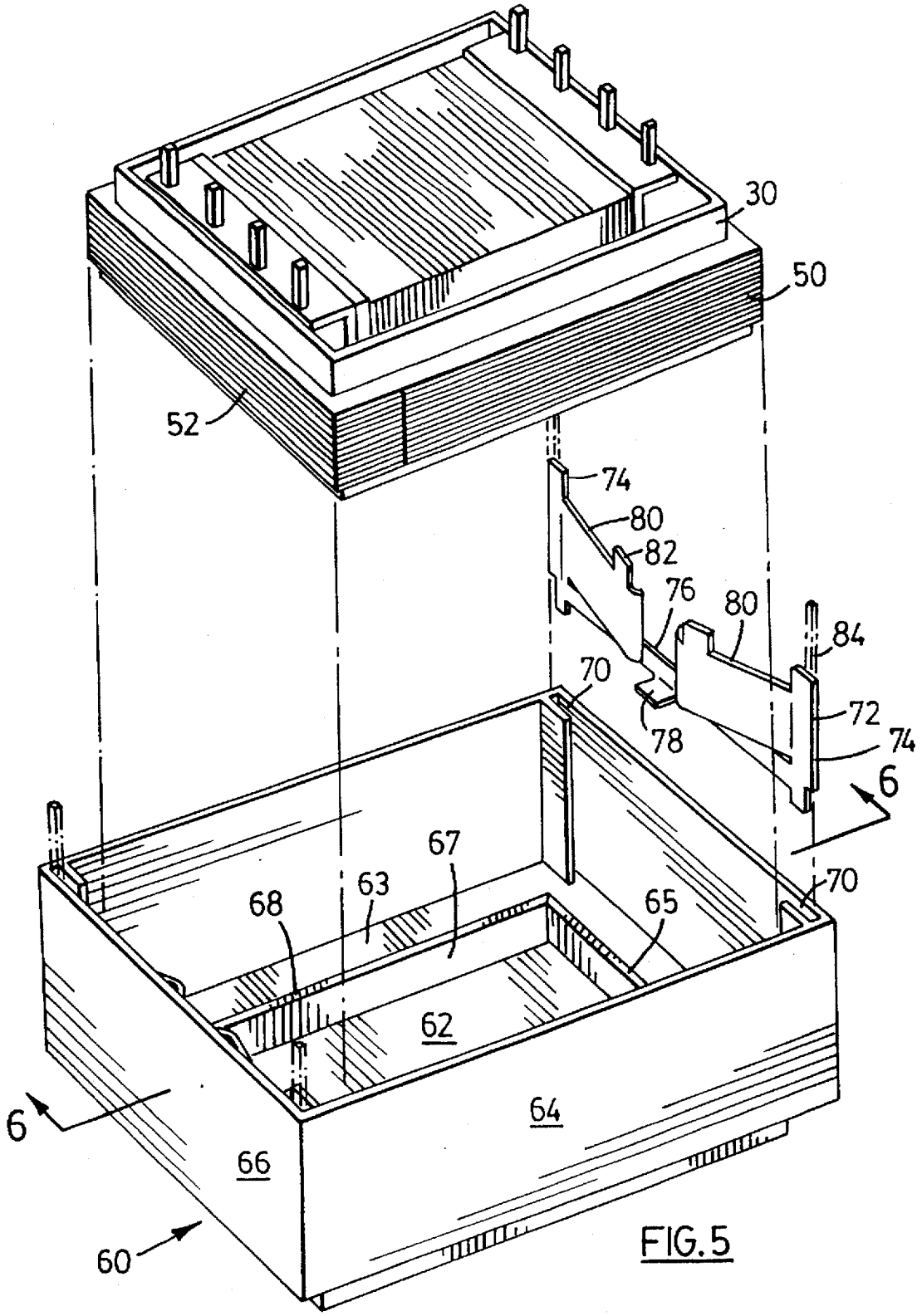
FIG. 5 is a perspective view showing insertion of the bobbin and core assembly of FIG. 4 and springs into an assembly cup.

This assembly is inverted, so that the connecting pins 24 are uppermost and this assembly is inserted into an assembly cup 60, as shown in FIG. 5. The assembly cup 60 in the orientation shown in the FIG. 5 has a base 62 side walls 64 and end walls 66, the side and end wall 64, 66 being of generally similar dimensions so as to give a square profile in plan view. As shown at 68, there is a narrow step around the base 62, where it joins the walls 64, 66. Around the base 62, there are side and end wall portions 65, 67, inset in from the side and end walls 64, 66 and dimensioned to be a snug or interference fit with the assembly cap 30. An outer base portion 63 extends between the wall portions 65, 67 and walls 64, 66. Again these wall portions 65, 67 are bevelled, to facilitate insertion.

Referring to FIGS. 5 and 6, the assembly cup has slots 70 for receiving springs 72. Each spring 72 has two side legs 74 connected by a transverse part 76. A locking tab 78 extends perpendicularly to the transverse part 76. Two spring arms 80 extend towards one another from the legs 74 and slightly away from the end walls 66. The arms 80 have extension tabs 82 to ensure that they engage the laminations 50, 52. The springs 72 are inserted into the slots 70 and resiliently bias the laminations 50, 52 together and into the middle of the cup 60. The tabs 78 engage the tops of the lamination stacks, to prevent the springs being displaced. This spring design is intended for use with the shape of pins 24 adapted for insertion into throughholes in a printed circuit board. As bobbin assembly is inserted into the cup 60, the spring arms 80 are deflected back to enable the laminations to enter the cup 60. Alternatively, simple rectangular spring strips (not shown) can be used.

It can be noted that each of the springs 72 only contacts either the laminations 50 or the laminations 52; in other words, no spring contacts both laminations 50 and 52. This can effectively short the laminations 50, 52 together, disrupting the effect of the insulating paper strip or other gap material 54. The gap material 54 reduces the permeability and inductance, and this effect can be impaired by shorting of the laminations. Additionally, to facilitate assembly and provide additional insulation, the laminations 50, 52, when assembled can be wound around the outside with a layer of insulating tape. In contrast, many known transformer designs provide spring arrangements that effectively provide an electrical connection between different groups of laminations.

For reasons which are detailed below, the assembly cup 60 has small protrusions 87 at the corners of the side and end walls 64, 66. These serve to ensure that the cup 60 is spaced from a printed circuit board.

To facilitate insertion of the assembly of FIG. 4 into the assembly cup 60, the upper edges of the wall 44 of cap 30 are bevelled (FIG. 6). The upper end of the cap 30 engages the inset wall portions 65, 67. As noted, a snug or interference fit is formed, so as to securely locate and retain the cap 30 within the assembly cup 60. As FIG. 6 shows, the flange 34 then abuts the outer base portion 63, to provide a further sealing effect.

To seal the transformer, a suitable resin or other plastic material 90 is poured in to surround bobbins 11, 12 within the central portion 32 of the assembly cap 30. As the bobbins 11, 12 are a sufficiently tight fit so as to form the seal with the end walls of the central portion 32 and as the cap is sealed to the inset wall portions 65, 67, the resin or other material is prevented from leaking out of the cap 30 and around the laminations. Depending on the material, it can be cured by heat, ultraviolet light, or otherwise.

The material 90 also holds the pins 24 in position. This is an important mechanical characteristic. In many conventional transformer designs, the pins are poorly mounted and the mounting is not capable of withstanding loads that can be applied in use. Here, the resin 90 reinforces the pins 24.

Hence, even after sealing, the laminations 50, 52 are free to float with respect to the rest of the assembly, and for this purpose are provided with sufficient internal and external clearance.

The bobbin assembly 10 of the present invention has a number of advantages. By providing separate bobbins 11, 12, nested or telescoped within one another, there is provided a configuration which can gave a magnetic and electrical efficiency suitable for audio, data and other high frequency applications. At the same time, various elements provide for relatively large creepage distances, enabling recent standards, such as those originating in Europe to be met. It enables a working voltage of either 150 or 250 volts to be achieved, which is required according to the new European standard for audio transformers. The configuration of the cap 30 with its flanges 34, 36 provides significant creepage distances with respect to the laminations 50, 52 and the coils on the bobbins.

The configuration and manner of assembly of the different components is well suited to modern manufacturing techniques. The cap 30 serves to both facilitate the insertion of the laminations 50, 52, and to hold them in place. In particular, it is often necessary to adjust the thickness of the gap material 54, to obtain the desired magnetic characteristics. To this end, where paper strips 54 are used, strips 54 of different thicknesses can be inserted, without having to remove the laminations 50, 52. It may be possible to ease the laminations 50, 52 apart slightly to enable the paper strip 54 to be removed and a different paper strip with a different thickness inserted.

The provision of the interference fit between the cap 30 and cup 60, as well as other features, enables the assembly to be effected by automated machinery, such as a "pick and place" robot or the like. The cap 30, cup 60 and bodies of the bobbins 11, 12 can all be accurately molded in a plastics material. Since all these various elements securely fit within one another, by way of interference fits and the like, this accurately locates the pins 24 with respect to the cup 60. This is important for automated assembly of printed circuit boards. A robotic device or the like can be programmed to pick up a complete transformer by the cup 60, and the relative position of the pins 24 can then be accurately determined, to enable the transformer to be inserted into a printed circuit board. By way of contrast, the laminations 50, 52 typically are stamped to relatively poor tolerances, and in any event, here are provided with a capacity to float. Hence, if the mechanical connection between the cap 30 and cup 60 was through the laminations 50, 52, this would provide for very poor tolerances on the relative position of the pins 24 to the cup 60 providing the outer surface of the completed transformer.

When a complete transformer has been mounted on a printed circuit board, the protrusions 87 serve to space it slightly, here by approximately 0.5 mm, from the surface of the board. The reason of this is that many printed circuit boards are washed with a solvent or the like to remove excess flux. This spacing enables such a washing solution to flow under the transformer and around the pins 24, soldered connections etc, to enable flux to be washed away. This additional spacing also improves the creepage characteristics, by providing for further spacing for a printed circuit board.

Figure 1A:
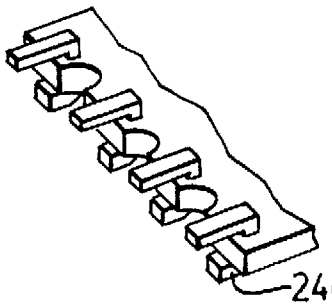
Figure 9:
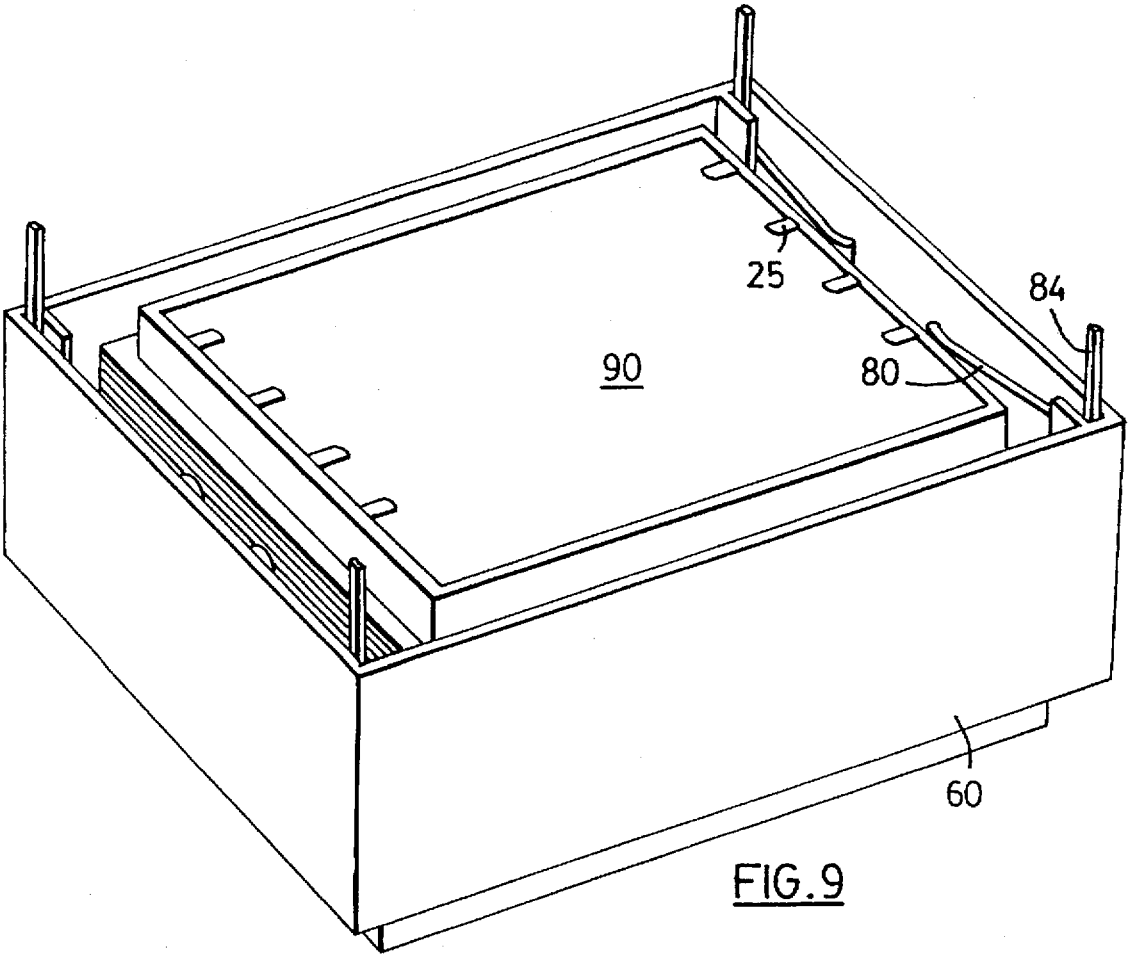
FIG. 9 is a bottom perspective view of an alternative embodiment, for surface mounting.

FIGS., 5 and 9 show an alternative embodiment of the springs for use with surface mount pins 24*a*, as shown in FIG. 1*a*. For surface mount pins 24*a*, the flange 22 can be essentially the same, and the pins 24*a* provide pads for soldering to pads on the circuit board. Here, an extension leg 84 (shown dotted in FIG. 5 and in solid in FIG. 9) is provided for each leg 74 of the spring for extending through a throughhole in a printed circuit board, to which it can be secured by soldering in known manner.

The provision of springs 72 locates the laminations 50, 52 in place, while permitting expansion and contraction. Also, the configuration is such as to protect the coils 18 within the assembly cup 60. This is important. The infrared reflow soldering technique, although it reduces the amount of solder used and the amount of cleaning chemicals and the like used, can impart higher heat loadings onto individual components. The configuration of this transformer will prevent excessive heat from this technique reaching the coils 18. The mounting for the laminations 50, 52 enables them to expand and contract during such a soldering operation when the bobbin or transformer assembly 10 is mounted in a printed circuit board or the like.

I claim:

1. A transformer assembly comprising:

a first bobbin having a first main bobbin body comprising a first main bobbin portion and first and second end flanges at either end of thereof, and a coil wound on the first main bobbin portion, the first main bobbin body defining a first bore for laminations;

a second bobbin having a second main bobbin body comprising a second main bobbin portion and first and second end flanges at either end thereof and having generally similar external dimensions, and a coil wound on the second main bobbin portion, the second main bobbin body defining a second bore, the second bobbin being larger than the first bobbin, the second end flange of the first bobbin being dimensioned to fit within the second bore, and the bobbins being telescoped within one another with the second bore being dimensioned to receive the first main bobbin body; and an assembly cap comprising side and end walls defining a central portion and a substantially rectangular aperture extending through the central portion, in which the first and second bobbins are mounted, with at least one of said first and second bobbin end flanges abutting each of the respective end walls and the end walls including openings aligned with the first bore of the first bobbin for receiving laminations, wherein the assembly cap includes top and bottom flanges provided above and below the openings in the central portion for locating laminations and for providing desired creepage characteristics, and wherein the end walls and the end flanges are all substantially perpendicular to axes of the first and second bores, to permit sliding engagement of the end flanges by the assembly cap and the end flanges abutting the end walls forming a seal sufficient to prevent passage of a liquid resin.

2. A transformer assembly as claimed in claim 1, wherein at least one edge of each of the first end flanges is bevelled, the bevelled edges being on the same side of the assembly, to facilitate insertion of the first and second bobbins into the rectangular aperture.

3. A transformer assembly as claimed in claim 1, wherein at least one of the first bobbin body adjacent the second flange thereof and the second bobbin body adjacent the first flange thereof has protrusion means for forming an interference fit between the first and second bobbin bodies.

4. A transformer as claimed in claim 1, wherein the cap is generally rectilinear and the top and bottom flanges include bevelled edges facing one another for facilitating insertion of laminations.

5. A transformer as claimed in claim 4, wherein the top flange includes set back portions on the bottom surface thereof, aligned with the openings of the central portion and a top surface of the bottom flange includes bevelled edge surfaces.

6. A transformer assembly as claimed in claim 1, wherein the central portion includes a downwardly extending lip extending below the bottom flange.

7. A transformer assembly as claimed in claim 6, wherein each of the first and second bobbins includes a mounting flange extending generally perpendicularly to the respective first end flange and a plurality of connecting pins mounted in the respective mounting flange and connected to the coil thereof, and wherein the lip is dimensioned to enclose the mounting flanges.

8. A transformer assembly as claimed in claim 7, which includes a plurality of laminations mounted between the top and bottom flanges of the cap.

9. A transformer assembly as claimed in claim 8, wherein the cap is generally rectangular in plan and the bores of the first and second bobbins are generally rectangular, and wherein the laminations comprise a first group of laminations having a generally E-shape, extending through the bore of the first bobbin and along either side thereof and a second group of laminations having one of a generally I-shape and a E-shape located abutting ends of the first groups of laminations, and wherein a gap sheet means is provided between the first and second groups of laminations, to isolate them from one another.

10. A transformer assembly as claimed in claim 8, which includes an assembly cup means enclosing the first and second bobbins, the assembly cap and the laminations, and retaining the laminations in position.

11. A transformer assembly as claimed in claim 10, wherein the assembly cup means is secured to the assembly cap and includes spring biasing means biasing the laminations into abutment with one another.

12. A transformer assembly as claimed in claim 11, wherein the assembly cup includes a coupling formation adapted to receive a central portion of the assembly cap, to locate the assembly cap in the assembly cup, to close off the aperture in the central portion of the assembly cap, and wherein the central aperture of the assembly cap is filled with resin, to encase at least the coil of the second bobbin and the upper ends of the connecting pins.

13. A transformer as claimed in claim 12, wherein the connecting pins extend through the mounting flanges and comprise lower ends adapted for connection to a printed circuit board and upper ends connected to ends of the respective coil.

14. A transformer as claimed in claim 13, wherein each of the first end flanges includes a slit means, through which ends of the respective coil extend, while maintaining ends of the coil spaced inwardly from sides of the bobbin, and ends of each coil extend along the top of a respective mounting flange to the connecting pins.

15. A transformer as claimed in claim 1, 9, or 14 wherein the axial length of the first bobbin and the internal dimensions of the central section of the assembly cap are such as to provide an interference fit therebetween, to provide a seal between the first bobbin and the assembly cap to prevent resin leaking out from the rectangular aperture.

16. A transformer assembly comprising:

a first bobbin having a first main bobbin body comprising a first main bobbin portion and first and second end flanges at either end of thereof, and a coil wound on the first main bobbin portion, the first main bobbin body defining a first bore for laminations;

a second bobbin having a second main bobbin body comprising a second main bobbin portion and first and second end flanges at either end thereof and having generally similar external dimensions, and a coil wound on the second main bobbin portion, the second main bobbin body defining a second bore, the second bobbin being larger than the first bobbin, the second end flange of the first bobbin being dimensioned to fit within the second bore, and the bobbins being telescoped within one another with the second bore being dimensioned to receive the first main bobbin body;

an assembly cap comprising side and end walls defining a central portion and a substantially rectangular aperture extending through the central portion, in which the first and second bobbins are mounted, at least two of said first and second bobbin end flanges abutting the end walls and the end walls including openings aligned with the first bore of the first bobbin;

a plurality of laminations configured and mounted to extend through the bore of the first bobbin and to surround the assembly cap; and an assembly cup secured to the assembly cap and maintaining the laminations in position wherein the end walls and the end flanges are all substantially perpendicular to axes of the first and second bores, to permit sliding engagement of the end flanges by the assembly cap.

17. A transformer assembly as claimed in claim 16, wherein the assembly cup comprises a base, side walls and end walls, with the side and end walls being spaced from the laminations, and including lamination location means biasing the laminations into abutment with one another and providing for thermal expansion and contraction of the laminations.

18. A transformer assembly as claimed in claim 17, wherein the lamination location means comprises spring means provided on at least one of the side and end walls of the assembly cup.

19. A transformer assembly as claimed in claim 18, wherein the assembly cup includes a coupling formation adapted to receive the central portion of the assembly cap, to locate the assembly cap in the assembly cup.

20. A transformer assembly as claimed in claim 19, wherein the assembly cup is substantially continuous across the central portion so as to close off the rectangular aperture therein.

21. A transformer as claimed in claim 19, wherein the assembly cap is closed at the top thereof.

22. A transformer assembly as claimed in claim 18, wherein the spring means comprises first and second springs mounted to either end wall of the cup.

23. A transformer as claimed in claim 1, wherein the first and second end flanges of the second bobbin and the first end flange of the first bobbin all having a generally similar heights and widths.

24. A transformer as claimed in claim 23, wherein the second end flange of the first bobbin has an extended axial length to provide a desired creepage characteristic.

25. A transformer assembly as claimed in claim 24, wherein the axial length of the second end flange of the first bobbin is approximately twice the thickness thereof.

26. A transformer as claimed in claim 1, 24, 9, or 14 wherein the first and second end flanges of the first bobbin abut the end walls and wherein the axial length of the first bobbin is greater than the axial spacing between the end walls, to form an interference fit, for forming a seal sufficient to prevent the passage of liquid resin.

27. A transformer as claimed in claim 16, 18 or 21, wherein the first and second end flanges of the first bobbin abut the end walls and wherein the axial length of the first bobbin is greater than the axial spacing between the end walls, to form an interference fit, for forming a seal sufficient to prevent the passage of liquid resin.

* * * * *